US010192534B2

(12) United States Patent
Yudasaka et al.

(10) Patent No.: US 10,192,534 B2
(45) Date of Patent: Jan. 29, 2019

(54) PERCUSSION INSTRUMENT

(71) Applicant: Yamaha Corporation, Hamamatsu, Shizuoka (JP)

(72) Inventors: Takuto Yudasaka, Shizuoka (JP); Masakazu Kato, Shizuoka (JP); Keizo Harada, Shizuoka (JP)

(73) Assignee: YAMAHA CORPORATION, Shizuoka (JP)

( * ) Notice: Subject to any disclaimer, the term of this patent is extended or adjusted under 35 U.S.C. 154(b) by 0 days.

(21) Appl. No.: 15/952,836

(22) Filed: Apr. 13, 2018

(65) Prior Publication Data

US 2018/0330701 A1 Nov. 15, 2018

(30) Foreign Application Priority Data

May 11, 2017 (JP) ..... 2017-094660

(51) Int. Cl.

| | |
|---|---|
| ***G10H 1/32*** | (2006.01) |
| ***G10H 1/00*** | (2006.01) |
| ***G10D 13/02*** | (2006.01) |
| ***H04R 1/02*** | (2006.01) |

(52) U.S. Cl.

CPC ..... *G10H 1/0008* (2013.01); *G10D 13/027* (2013.01); *G10D 13/028* (2013.01); *G10H 1/32* (2013.01); *H04R 1/025* (2013.01); *G10H 2220/461* (2013.01); *H04R 2201/028* (2013.01)

(58) Field of Classification Search

CPC .. G10H 1/0008; G10H 1/32; G10H 2220/461; G10D 13/027; G10D 13/028; H04R 1/025; H04R 2201/028

USPC ..... 84/670, 730, 746, 743

See application file for complete search history.

(56) References Cited

U.S. PATENT DOCUMENTS

| | | | | |
|---|---|---|---|---|
| 3,553,339 | A * | 1/1971 | Dominguez | G10H 3/146 84/725 |
| 3,956,959 | A | 5/1976 | Ebihara et al. | |
| 4,242,937 | A * | 1/1981 | Pozar | G10D 13/02 84/411 R |
| 4,732,070 | A * | 3/1988 | Yamashita | G10H 3/146 248/188.5 |
| 5,361,669 | A * | 11/1994 | Genna | G10D 13/021 181/156 |
| 5,430,245 | A * | 7/1995 | Rogers | G10H 3/146 84/725 |
| 5,811,709 | A * | 9/1998 | Adinolfi | G10D 13/024 84/723 |
| 6,121,528 | A * | 9/2000 | May | G10D 13/02 84/411 R |
| 7,282,633 | B1 * | 10/2007 | Coolidge | G10H 3/143 84/104 |

(Continued)

FOREIGN PATENT DOCUMENTS

JP 2007-156048 A 6/2007

*Primary Examiner* — Jeffrey Donels

(74) *Attorney, Agent, or Firm* — Global IP Counselors, LLP

(57) ABSTRACT

A percussion instrument is provided that includes a shell, a head and a speaker. The shell has a wall portion and at least one opening. The head is attached to the shell and overlies the at least one opening of the shell. The speaker is provided inside of the shell and oriented to output sound having a main direction of propagation towards the wall portion of the shell and/or the at least one opening of the shell having the head according to an input signal.

20 Claims, 5 Drawing Sheets

(56) References Cited

U.S. PATENT DOCUMENTS

| | | | | |
|---|---|---|---|---|
| 7,525,039 | B2 * | 4/2009 | Steele | G10H 3/146 84/743 |
| 7,560,632 | B1 | 7/2009 | Lanzel et al. | |
| 7,657,051 | B1 * | 2/2010 | Kahoe | H04R 1/021 381/162 |
| 7,737,351 | B2 | 6/2010 | Suzuki | |
| 8,071,871 | B2 * | 12/2011 | Peavey | G10D 13/021 84/725 |
| 8,536,434 | B2 | 9/2013 | Ruffino | |
| 9,153,220 | B2 * | 10/2015 | Kanayama | G10H 3/143 |
| 9,196,237 | B2 * | 11/2015 | Kanayama | G10H 3/146 |
| 9,378,714 | B1 * | 6/2016 | Baldwin, Sr. | G10D 13/024 |
| 9,589,552 | B1 * | 3/2017 | Nishi | G10H 3/12 |
| 9,972,296 | B2 * | 5/2018 | Steele | G10H 3/146 |
| 2004/0211310 | A1 * | 10/2004 | Hagiwara | G10D 13/00 84/726 |
| 2005/0022655 | A1 * | 2/2005 | Wise | G10H 3/146 84/743 |
| 2008/0121088 | A1 * | 5/2008 | Curet Troche | G10D 13/02 84/413 |
| 2014/0260918 | A1 | 9/2014 | Kanayama et al. | |
| 2014/0260921 | A1 * | 9/2014 | Kanayama | G10H 3/146 84/730 |
| 2018/0025711 | A1 * | 1/2018 | Bhamra | G10H 1/00 84/600 |

* cited by examiner

PERCUSSION INSTRUMENT

CROSS-REFERENCE TO RELATED APPLICATIONS

This application claims priority to Japanese Patent Application No. 2017-094660, filed on May 11, 2017. The entire disclosure of Japanese Patent Application No. 2017-094660 is hereby incorporated herein by reference.

BACKGROUND

Technical Field

The present invention generally relates to a percussion instrument.

Background Information

In a percussion instrument having a tubular shell, and a head attached to an opening of the shell, the head vibrates and raw sound is emitted from the percussion instrument when the head is struck.

One example of a percussion instrument is disclosed in Japanese Laid-Open Patent Publication No. 2007-156048. In this, publication, a percussion instrument is provided with a vibration pickup that converts vibration of the head into an electronic signal inside the shell. The electronic signal acquired by the vibration pickup is emitted as sound from a loudspeaker device such as a headphone or a speaker.

SUMMARY

The only sound that is emitted from a conventional percussion instrument is sound (raw sound) that is generated by vibrating a portion of the percussion instrument, such as the head. There is a demand for this type of percussion instrument to diversify the sounds that are emitted from the percussion instrument in order to improve the expressiveness and functionality of the percussion instrument.

In view of the circumstance described above, one object of the present invention is to provide a percussion instrument that is capable of diversifying the sounds that are emitted from the percussion instrument and enhancing the expressiveness and functionality of the percussion instrument.

The percussion instrument according to the present invention basically comprises a shell, a head and a speaker. The shell has a wall portion and at least one opening. The head is attached to the shell and overlies the at least one opening of the shell. The speaker is provided inside of the shell and oriented to output sound having a main direction of propagation towards the wall portion of the shell and/or the at least one opening of the shell having the head according to an input signal.

According to the present invention, not only the sound (raw sound) that is made when a predetermined portion of a percussion instrument, such as the head, is struck, but also the sound from the speaker can be emitted from the percussion instrument. It is thereby possible to diversify the sounds that are emitted from the percussion instrument. Therefore, it is possible to improve the expressiveness and the functionality of the percussion instrument.

BRIEF DESCRIPTION OF THE DRAWINGS

Referring now to the attached drawings which form a part of this original disclosure.

DETAILED DESCRIPTION OF EMBODIMENTS

Selected embodiments will now be explained with reference to the drawings. It will be apparent to those skilled in the bicycle field from this disclosure that the following descriptions of the embodiments are provided for illustration only and not for the purpose of limiting the invention as defined by the appended claims and their equivalents.

First Embodiment

Figure 1:
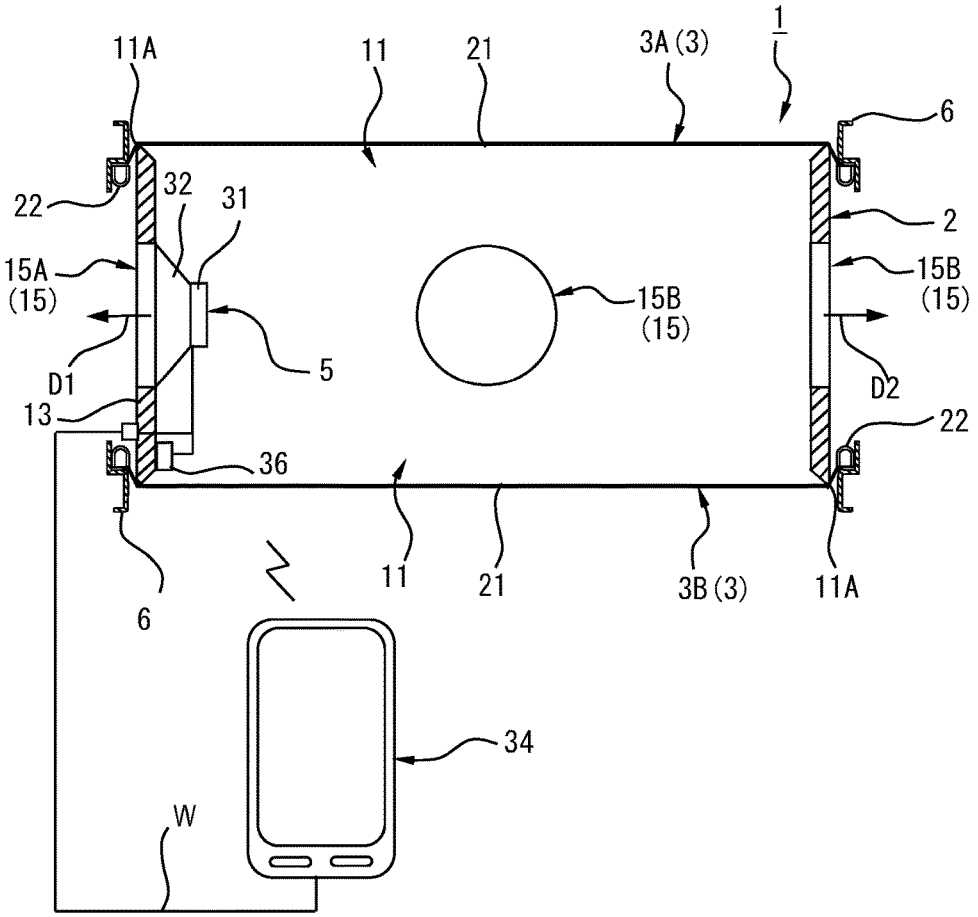
FIG. 1 is a simplified cross-sectional view of a percussion instrument according to a first embodiment.

A first embodiment of a percussion instrument 1 will be described with reference to FIG. 1. As shown in FIG. 1, the percussion instrument 1 according to the first embodiment comprises a shell 2 (body portion), a head (membrane portion) 3, and a speaker (sound-emitting portion) 5.

The shell 2 comprises a cavity formed therein, and an opening 11 that connects the cavity to the outside. The shape of the shell 2 is arbitrary. The shell 2 can be formed into a bowl shape with a single opening 11, like a tympani, or can be formed into a tubular shape with a pair of the openings 11 at both ends in the axial direction. In addition, the shell 2 can have the form of a rectangular tube, or a form in which the diameter dimension of the shell 2 (inner diameter dimension, outer dimension) changes in the axial direction of the shell 2, like that of a bongo drum, a conga drum, etc. The shell 2 of the first embodiment has a cylindrical form in which the diameter dimension does not change in the axial direction of the shell 2 (vertical direction in FIG. 1). The shell 2 can be formed from a material such as wood or metal.

The head 3 has the form of a film form, such as a PET (polyethylene terephthalate) film, or the like, and is attached to one or both of the openings 11 of the shell 2. Here, in the illustrated embodiments, the percussion instrument 1 has two of the heads 3. In a state in which the heads 3 are attached to the shell 2 and overlie the openings 11 of the shell 2, tension is applied to a portion 21 of each of the heads 3 that is disposed on the inner side of peripheral edge portions 11A of the openings 11 of the shell 2 (hereinafter referred to as "the inner membrane portion 21" of the head 3.) Thus, the inner membrane portions 21 are stretched over the openings 11 of the shell 2. As a result, when an external force, such as a stroke, acts on the inner membrane portion 21 of the head 3, the inner membrane portion 21 of the head 3 vibrates.

The configuration for applying tension to the inner membrane portion 21 of the head 3 is arbitrary. In the first embodiment, tension is applied to the inner membrane portion 21 of the head 3 by using a conventionally well-known hoop 6, a plurality of lugs (not shown), and a plurality of tuning bolts (not shown), which are arranged around the outer perimeter of the shell 2 to press a flesh hoop 22 of the head 3 in the axial direction of the shell 2.

The head 3 can be attached, for example, to only one of the openings 11 of the shell 2. However, one of the heads 3 is attached to each of the openings 11 of the shell 2 in the present embodiment. The percussion instrument 1 of the first embodiment is a drum in which a first head 3A of the heads 3 forms a batter head that is struck with a drumstick, or the like, and a second head 3B of the heads 3 forms a resonant head that is not struck.

The speaker 5 is provided on the inside of the shell 2 and outputs a sound corresponding to an input signal. Here, in the first embodiment, the speaker 5 is attached to an inner side of the shell 2. The configuration of the speaker 5 is arbitrary. The speaker 5 of the first embodiment comprises a vibrator 31 that vibrates based on an electronic signal as an input signal, and a diaphragm 32 that radiates sound by vibrating together with the vibrator 31.

The vibrator 31 can be, for example, a voice coil type actuator. The diaphragm 32 is not limited to the cone shape (conical shape, truncated-cone shape) shown in the drawing, but can be freely formed, for example, into a flat-plate shape. In the first embodiment, the dimensions of the speaker 5 in an arrangement direction of the vibrator 31 and the diaphragm 32 are smaller than the dimensions of the speaker 5 in a direction orthogonal to the arrangement direction.

The speaker 5 can be configured to radiate sound in all directions, such as sound from a point source. The speaker 5 of the first embodiment is configured to output sound in a direction that is limited to a certain degree (to have a certain degree of directionality). In the first embodiment, a main direction of propagation of the sound that is output from the speaker 5 is a direction in which the vibrator 31 and the diaphragm 32 are arranged (direction indicated by arrow D1 in FIG. 1). More specifically, in the speaker 5 of the first embodiment, the diaphragm 32 is formed into a truncated cone shape having a center axis that the whole cone has a circular symmetry. Accordingly, the main sound that emanates from the speaker 5 is output from the inner surface of the conical diaphragm 32 as a spherical wave propagating in the D1 direction (the main direction of propagation). In the case of a speaker having cone shaped diaphragm, the main direction of propagation of the sound as used herein corresponds to the cylinder having a diameter that is equal to a diameter of a base of the cone shaped diaphragm and a center coincident to a center of the base of the cone shaped diaphragm. In addition, in the speaker 5 of the first embodiment, sound (hereinafter referred to as other sound) is also transmitted from the outer surface of the conical diaphragm 32 in the direction opposite to the D1 direction as well as in the direction orthogonal to the D1 direction.

The speaker 5 of the first embodiment is disposed so as to output sound toward a wall portion 13 of the shell 2. Specifically, the speaker 5 is disposed so as to output sound toward a through-hole 15A (first through hole 15A) formed in the wall portion 13 of the shell 2. The main sound that is output from the speaker 5 propagates mainly in a radial direction of the shell 2 (D1 direction in FIG. 1). The main sound that is output from the speaker 5 reaches the wail portion 13 of the shell 2 and the first through-hole 15A formed in the wall portion 13 from the speaker 5 directly, but does not directly reach the openings 11 of the shell 2 or the heads 3 attached to the opening 11. Thus, the sound that is output from the speaker 5 is proactively radiated to the outside of the shell 2 (percussion instrument 1) through the first through-hole 15A.

For example, the speaker 5 can be spaced at an interval from the first through-hole 15A of the shell 2 or disposed so as to block the first through-hole 15A of the shell 2 with the diaphragm 32, as illustrated in FIG. 1. The speaker 5 can be held by the shell 2 by being attached to the shell 2 directly or via a support member, which is not shown.

A through-hole 15B (second through-hole 15B), which is different from the first through-hole 15A, is formed in the wall portion 13 of the shell 2 of the first embodiment. The size of the second through-hole 15B can be the same as or different from the first through-hole 15A. The number of second through-holes 15B is arbitrary. If the number of second through-holes 15B is plural, the plurality of second through-holes 15B can be arranged, for example, at intervals in the circumferential direction of the shell 2. The number of second through-holes 15B in the present embodiment is three (only two shown).

The second through-holes 15B can be arranged arbitrarily with respect to the first through-hole 15A, and are arranged at an interval in the circumferential direction of the shell 2 in the first embodiment. Specifically, the second through-holes 15B of the first embodiment are disposed so as to be arranged in the radial direction of the shell 2. Preferably, one of the second through-holes 15B of the first embodiment is disposed radially opposite with respect to the first through-hole 15A. That is, the first through-hole 15A and one of the second through-holes 15B are opened from the inner side of the shell 2 to the outer side of the shell 2 in mutually opposing directions.

The input signal to the speaker 5 described above can be a signal (electronic signal) that represents at least a sound that can be output from the speaker 5. The input signal can include, for example, information regarding the volume of the speaker 5 (the magnitude of the sound that is output from the speaker 5).

The input signal can be input from any external device. The input signal can be, for example, a signal representing a sound that is output from a musical sound reproducing device, such as an audio device and a portable music player (musical sound, accompaniment sound), a sound that is output from various instruments (instrument sound), or a clicking sound (metronome sound) that is output from a predetermined electronic device at predetermined intervals.

The transmission of the input signal from an external device 34 to the speaker 5 can be carried out by wiring W that connects the external device 34 and the speaker 5 (wired communications), or can be carried out through wirelessly communications such as Bluetooth®. In the case of wirelessly communications, the percussion instrument 1 is provided with a wireless receiver 36.

As described above, according to the percussion instrument 1 of the first embodiment, the speaker 5 that outputs sound according to an input signal is provided on the inner side of the shell 2. As a result, not only the sound (raw sound) of predetermined portions of the percussion instrument 1, such as the head 3 and the hoop 6, being struck, but also the sound from the speaker 5 can be radiated from the percussion instrument 1. It is thereby possible to diversify the sounds that are emitted from the percussion instrument 1. Therefore, it is possible to improve the expressiveness and the functionality of the percussion instrument 1.

For example, by outputting musical sounds or accompaniment sounds from the speaker 5, the performer of the percussion instrument 1 is able to play the percussion instrument 1 in accordance with a musical piece or accompaniment. It is thereby possible to improve the expressiveness during the playing of the percussion instrument 1. In addition, for example, it is possible for one to effectively practice the percussion instrument 1 by outputting a metronome sound or an accompaniment sound from the speaker 5. Additionally, for example, by outputting the instrument sounds of other instruments from the speaker 5 when the percussion instrument 1 is played together with other instruments, the player of the percussion instrument 1 is able to easily adjust the timing and intensity (magnitude of the raw sound) of striking the predetermined portion of the percussion instrument 1 with respect to the instrument sounds of the other instruments.

In addition, in accordance with the percussion instrument 1 of the first embodiment, the speaker 5 is provided on the inner side of the shell 2. Thus, it is possible for the sound that is output from the speaker 5 to the outside of the percussion instrument 1 to reflect the acoustic characteristics of the shell 2 and the head 3A.

Additionally, in accordance with the percussion instrument 1 of the first embodiment, the speaker 5 is disposed so as to output sound toward the wall portion 13 of the shell 2. Thus, it is possible to reduce the size of the speaker 5 as viewed from the side of the openings 11 (axial direction) of the shell 2, compared to a case in which the speaker 5 is disposed such that the sound from the speaker 5 is output toward one of the openings 11 of the shell 2. Thus, the inhibition by the speaker 5 of the sound made when the head 3A is struck (for example, expansion and elimination of sound) can be suitably suppressed.

In particular, in the percussion instrument 1 of the first embodiment, the speaker 5 is disposed near the inner perimeter surface of the shell 2 (the wall portion 13). Thus, it is possible to further suppress the difference between the sound of the head 3A of the percussion instrument 1 of the first embodiment being struck, and the sound of a head of a percussion instrument being struck in which a speaker is not provided in the shell, so that this difference is small. That is, it is possible to further suppress changes in the struck sound of the head 3A due to the installation of the speaker 5 in the shell 2.

In addition, in accordance with the percussion instrument 1 of the first embodiment, the speaker 5 is provided at the first through-hole 15A of the through-holes 15 formed in the wall portion 13 of the shell 2, and is not provided at one of the second through-holes 15B. As a result, it is possible to radiate the sound that is output from the speaker 5, not only from the first through-hole 15A as indicated by arrow D1 in FIG. 1, but also to the outside of the shell 2 from the second through-holes 15B as indicated by arrow D2 in FIG. 1. That is, it is possible to radiate the sound that is output from the speaker 5 in various directions from the percussion instrument 1 (particularly in various directions in the circumferential direction of the shell 2). As a result, it is possible to blur the sound image of the sound from the speaker 5 that is radiated to the outside of the percussion instrument 1 (to reduce the directionality of the sound from the speaker 5), as compared to a case in which a second through-hole is not formed. That is, it is possible to improve the localization of the sound that is output from the speaker 5.

From the foregoing, the performer of the percussion instrument 1 is able to hear both the sound from the speaker 5 and the sound of striking predetermined portions of the percussion instrument 1, such as the head 3 and the hoop 6, with the same impression as a listener listening to a performance of the percussion instrument 1 in a location farther away from the percussion instrument 1 than the performer.

In addition, in accordance with the percussion instrument 1 of the first embodiment, one of the second through-holes 15B formed in the shell 2 is disposed so as to be arranged in the radial direction of the shell 2 with respect to the first through-hole 15A. Thus, it is possible to radiate the sound from the speaker 5 to the outside of the shell 2 in mutually opposite directions from the first through-hole 15A and the one of the second through-boles 15B (refer to arrows D1, D2 in FIG. 1). As a result, it is possible to effectively improve the localization of the sound that is output from the speaker 5, even if there is only a small number of the through-holes 15 formed in the shell 2.

Additionally, in accordance with the percussion instrument 1 of the first embodiment, it is possible to propagate sound that is output from the speaker 5 (other sounds) toward the head 3A. Thus, if the frequency of the sound that is output from the speaker 5 is matched to the characteristic frequency of the head 3A, it is possible to further increase the vibration sound of the head 3 by vibrating the head 3A with the sound from the speaker 5.

The percussion instrument 1 of the first embodiment described above can comprise, for example, a plurality of speakers 5. In this case, a plurality of the first through-holes 15A can be formed in the wall portion 13 of the shell 2. The plurality of first through-holes 15A can be arranged, for example, at intervals in the circumferential direction of the shell 2. Additionally, two of the first through-holes 15A of the plurality of first through-holes 15A can be disposed, for example, in the radial direction of the shell 2. The plurality of speakers 5 can be arranged so that the sound is output toward respectively different first through-holes 15A. Even with a configuration in which a plurality of speakers 5 are disposed in this manner, it is possible to blur the sound image of the sound from the speaker 5 that is radiated to the outside from the percussion instrument 1. That is, it is possible to improve the localization of the sound that is output front the speaker 5.

Second Embodiment

Next, the second embodiment of the present invention will be described with reference to FIG. 2. In the present embodiment, the same compositional elements as those of the first embodiment have been given the same reference symbols, and descriptions thereof have been omitted.

Figure 2:
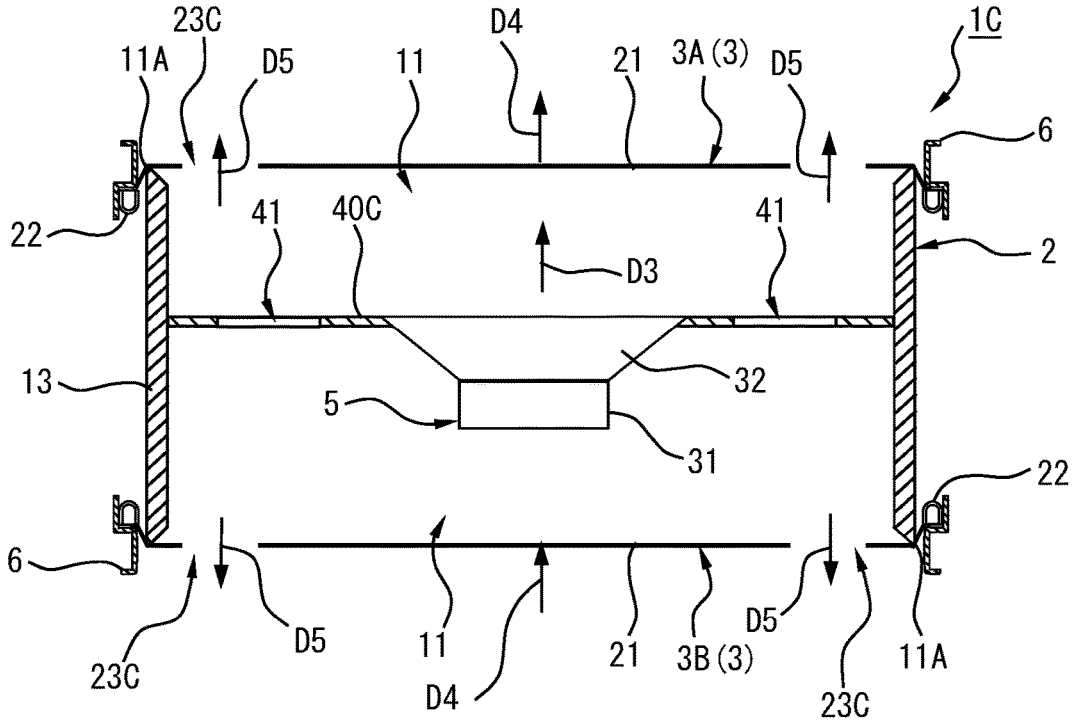
FIG. 2 is a simplified cross-sectional view of a percussion instrument according to a second embodiment.

As shown in FIG. 2, the percussion instrument 1C of the present embodiment comprises the same shell 2, the same head 3, and the same speaker 5 as the first embodiment. Thus, the speaker 5 of the second embodiment can be connected the external device 34 by the wiring W similar as to FIG. 1, and/or can be provided with provided with the wireless receiver 36 wirelessly communication with the external device 34.

However, in the percussion instrument 1C the second embodiment, a through-hole 15 (refer to FIG. 1) such as in the first embodiment is not formed in the wall portion 13 of the shell 2. In other words, the wall portion 13 of the shell 2 in the percussion instrument 1C does not have a through-hole that is dimensioned to radiate sound to the outside of the shell 2.

In addition, the speaker 5 of the second embodiment is disposed so as to output sound toward one of the openings 11 of the shell 2. Alternatively, the speaker 5 can be disposed, for example, to output sound toward the opening 11 of the shell 2 to which the second head 3B (resonant head) is attached. The speaker 5 of the second embodiment is disposed to output sound toward the opening 11 of the shell 2 to which the first head 3A (batter head) is attached. In FIG. 2, the main direction of propagation of the sound that is output from the speaker 5 is indicated by arrow D3.

In the second embodiment, the main sound that is output from the speaker 5 propagates mainly in the axial direction of the shell 2 (D3 direction in FIG. 2). The main sound that is output from the speaker 5 reaches the opening 11 of the shell 2 and the first head 3A attached to the opening 11 from the speaker 5 directly, but does not directly reach the wall portion 13 of the shell 2.

For example, the speaker 5 can be formed to have the same size as the internal space of the shell 2, as viewed from the side with the opening 11 of the shell 2, and can be disposed so as to divide the internal space of the shell 2 in the axial direction of the shell 2. The speaker 5 of the second embodiment is formed to be smaller than the internal space of the shell 2, as viewed from the opening 11 side of the shell 2.

The speaker 5 can be disposed, for example, in a position near the wall portion 13 (the inner perimeter surface) of the shell 2. The speaker 5 of the second embodiment is positioned away from the wall portion 13 (inner perimeter surface) of the shell 2, that is, positioned in the central portion of the internal space of the shell 2 as viewed from the side with the opening 11 of the shell 2. In addition, the speaker 5 of the second embodiment is disposed in a position that does not interfere with the head 3, even if the head 3 vibrates in the axial direction of the shell 2.

The speaker 5 of the second embodiment is held by the shell 2 by attachment to the shell via a support member 40C. The support member 40C can be configured at least so as not to inhibit the transmission of vibration between the two of the heads 3 by the air inside the shell 2. The support member 40C of the present embodiment is formed from a plate that surrounds the periphery of the speaker 5. One or more through-holes 41 are formed in the support member 40C that extends through in the plate thickness direction thereof.

That is, in the percussion instrument 1C of the second embodiment, the internal space of the shell 2 is divided in the axial direction of the shell 2 by the speaker 5 and the support member 40C, and the two divided internal spaces of the shell 2 communicate via the through-holes 41 of the support member 40C.

In the percussion instrument 1C of the second embodiment, the heads 3 can be formed, for example, in the same manner as in the first embodiment. In the second embodiment, one or more opening holes 23C are formed in the inner membrane portion 21 of each of the heads 3A and 3B and extends through the thickness direction thereof.

The size and forming position of the opening holes 23C are arbitrary. In the present embodiment, the opening holes 23C is formed in a region of the inner membrane portion 21 close to the edge portions 11A of the openings 11 of the shell 2. For example, only one of the opening holes 23C can be formed, but a plurality thereof are formed in the second embodiment. The plurality of opening holes 23C can be arranged, for example, at intervals in the circumferential direction of the shell 2.

As described above, the percussion instrument 1C of the second embodiment provides the same effects as those of the first embodiment.

Additionally, in accordance with the percussion instrument 1C of the second embodiment, the speaker 5 is disposed so as to output sound toward the openings 11 of the shell 2. Thus, it is possible to radiate sound that is output from the speaker 5 to the outside from the openings 11 of the shell 2. On the other hand, the raw sound (vibration sound) that is generated that accompanies the vibration of the heads 3, such as the sound the heads 3 makes when struck, is also mainly radiated to the outside from the opening 11 of the shell 2. In FIG. 2, the main direction of propagation of the vibration sound of the heads 3 is indicated by arrows D4. That is, it is possible to radiate sound from the speaker 5 in the same direction as the raw sound of the percussion instrument 1C. It is thereby possible to improve the localization of the sound that is output from the speaker 5.

From the foregoing, the performer of the percussion instrument 1C is able to hear both the sound from the speaker 5 and the sound of the heads 3 being struck, with the same impression as a listener listening to a performance of the percussion instrument 1C in a location that is farther away from the percussion instrument 1C than the performer.

Additionally, in the percussion instrument 1C the second embodiment, it is possible to improve the localization of the sound that is output from the speaker 5 without forming a through-hole in the wall portion 13 of the shell 2 as in the first embodiment. That is, it is possible to use a conventionally well-known shell 2 in which a through-hole is not formed.

In addition, in the percussion instrument 1C of the second embodiment, the sound from the speaker 5 is propagated toward the head 3 (the inner membrane portion 21) that is attached to the opening 11 of the shell 2. Thus, it is possible to proactively vibrate the head 3 with the sound from the speaker 5, in order to radiate the vibration sound of the head 3 to the outside of the percussion instrument 1C. In particular, if the frequency of the sound that is output from the speaker 5 is matched to the characteristic frequency of the head 3, it is possible to further increase the vibration sound of the head 3 by efficiently vibrating the head 3 with the sound from the speaker 5.

Additionally, in accordance with the percussion instrument 1C of the second embodiment, the opening holes 23C are formed in the heads 3 (the inner membrane portion 21). Thus, even if the output of sound from the speaker 5 is low, it is possible to efficiently radiate the sound from the speaker 5 to the outside of the percussion instrument 1C through the opening holes 23C of the heads 3, as shown by arrows D5 in FIG. 2. As a result, it becomes easier for the player of the percussion instrument 1C, and the like, to hear the sound from the speaker 5.

Third Embodiment

Next, the third embodiment of the present invention will be described with reference to FIG. 3. In the third embodiment, the same compositional elements as those in the first embodiment have been given the same reference symbols, and the descriptions thereof have been omitted.

Figure 3:
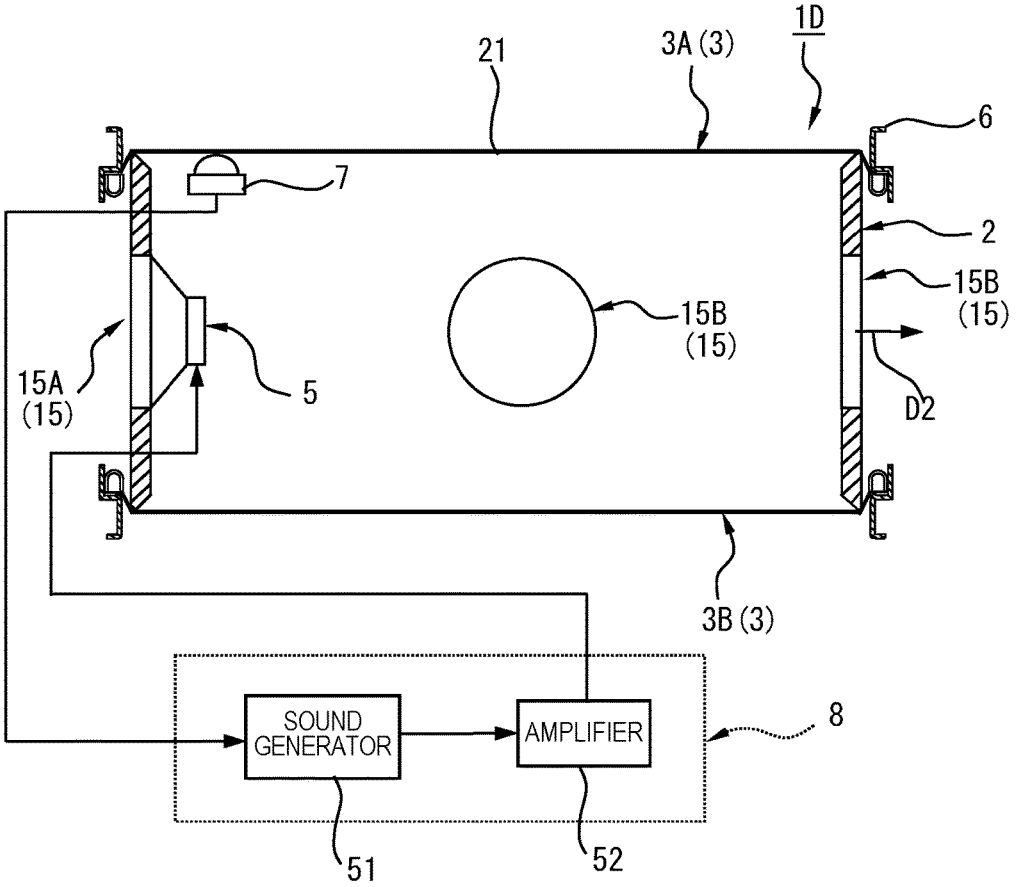
FIG. 3 is a simplified cross-sectional view of a percussion instrument according to a third embodiment.

As shown in FIG. 3, the percussion instrument 1D of the third embodiment comprises the same shell 2, the same head 3, and the same speaker 5 as in the first embodiment. Thus, the speaker 5 of the third embodiment can be connected the external device 34 by the wiring W similar to FIG. 1, and/or can be provided with provided with the wireless receiver 36 wirelessly communication with the external device 34.

In addition, in the percussion instrument 1D of the third embodiment, the speaker 5 outputs sound when a predetermined portion of the percussion instrument 1D, such as the head 3 or the hoop 6 is struck. Specifically, the percussion instrument 1D of the third embodiment comprises a sensor 7 and a speaker driving unit 8.

The sensor 7 can be a sensor that detects, for example, sound such as a microphone, or a sensor that detects, for example, vibration, The detection target of the sensor 7 can be sound or vibration that is generated when a predetermined portion of the percussion instrument 1D, such as the head 3 or the hoop 6, is struck. The sensor 7 can be provided so as to detect at least sound or vibration that is generated when a predetermined portion of the percussion instrument 1D is struck. The sensor 7 can be provided, for example, to the shell 2, the hoop 6, or the speaker 5, or can be provided, for example, in a position apart from the percussion instrument 1D. In addition, the sensor 7 can be provided, for example, on either the outer side or inside the shell 2. The sensor 7 can be provided, for example, on the outer side of the shell 2 so as to contact the head 3.

The sensor 7 of the third embodiment is provided inside the shell 2 so as to contact the first head 3A, which is struck with a drumstick, or the like, and mainly detects the vibration of the first head 3A.

The sensor 7 converts the detected vibration into an electronic signal and outputs the electronic signal to the speaker driving unit 8 as a detection signal. The transmission of the detection signal from the sensor 7 to the speaker driving unit 8 can be carried out by wiring that connects the sensor 7 and the speaker driving unit 8, or can be carried out wirelessly.

The speaker driving unit 8 drives the speaker 5 by outputting an input signal to the speaker 5 based on the detection signal that is output from the sensor 7. Thus, in the percussion instrument 1D of the third embodiment, the speaker 5 can output sound when a predetermined portion of the percussion instrument 1D is struck.

The specific configuration of the speaker driving unit 8 is arbitrary. The speaker driving unit 8 of the third embodiment comprises a sound generator 51 and an amplifier 52 (audio amplifier).

The sound generator 51 can store sound data that represent predetermined tones or acoustic characteristics. For example, the sound generator 51 can store a plurality of types of sound data. In this case, the sound generator 51 can have the function of selecting predetermined sound data. In addition, the sound generator 51 can have the function of creating, for example, sound data having the desired tone or acoustic characteristic.

The sound generator 51 generates a sound signal based on sound data, when a detection signal is input from the sensor 7. The sound generator 51 can, for example, directly output the generated sound signal to the speaker 5 as an input signal. The sound generator 51 of the third embodiment outputs the generated sound signal to the amplifier 52. The amplifier 52 amplifies the sound signal that is output from the sound generator 51 and outputs the amplified signal to the speaker 5 as an input signal.

The speaker driving unit 8 can be disposed, for example, inside the shell 2, but is disposed outside the shell 2 in the third embodiment. The transmission of the input signal from the speaker driving unit 8 to the speaker 5 can be carried out by wiring that connects the speaker driving unit 8 and the speaker 5, or can be carried out wirelessly.

As described above, the percussion instrument 1D of the third embodiment provides the same effects as those of the first embodiment.

In addition, with the percussion instrument 1D of the third embodiment, it is possible to output sound from the speaker 5 when a predetermined portion of the percussion instrument 1D, such as the head 3, is struck. Thus, it is possible to radiate sound, wherein the raw sound that is made when a predetermined portion of the percussion instrument 1D is struck and the sound that is output from the speaker 5 are mixed, to the outside from the percussion instrument 1D. It is thereby possible to further diversify the sounds (particularly tones and acoustic characteristics) that are emitted from the percussion instrument 1 and to further improve the expressiveness of the percussion instrument 1D.

Additionally, if the tone and the acoustic characteristic of the sound that is output from the speaker 5 are the same as the tone and the acoustic characteristic of the raw sound made when a predetermined portion of the percussion instrument 1D is struck, it is possible to increase the volume of the sound that is radiated from the percussion instrument 1D by adding the sound that is output from the speaker 5 on top of the raw sound.

In the third embodiment described above, for example, the speaker driving unit 8 can be configured to output the waveform of the sound or vibration detected by the sensor 7 as is to the speaker 5 as an input signal. In addition, the speaker driving unit 8 can, for example, not comprise the sound generator 51, and can amplify the waveform of the sound or vibration detected by the sensor 7 with the amplifier 52 and output the amplified sound to the speaker 5 as an input signal.

If a sound based on the waveform of sound or vibration is output from the speaker in this manner, then it is possible to output from the speaker 5 sound having the same tone and acoustic characteristic as the raw sound of a performer striking a predetermined portion of the percussion instrument 1D, even if the sound generator 51 is not provided.

Additionally, the speaker driving unit 8 can be provided with, for example, an effector that applies various effects (effects) to a signal that is output from the sensor 7 or the sound generator 51 (detection signal, sound signal). The types of effects are arbitrary, such as reverberation or distortion. The effector can apply any effect to the signal that is output from the sensor 7 or the sound generator 51 and then output the signal to the amplifier 52 or the speaker 5. It is thereby possible to output sound from the speaker 5 to which an effect has been applied.

In the third embodiment, the speaker 5 can output a different sound in accordance with, for example, the portion of the percussion instrument 1D that is struck.

Figure 4:
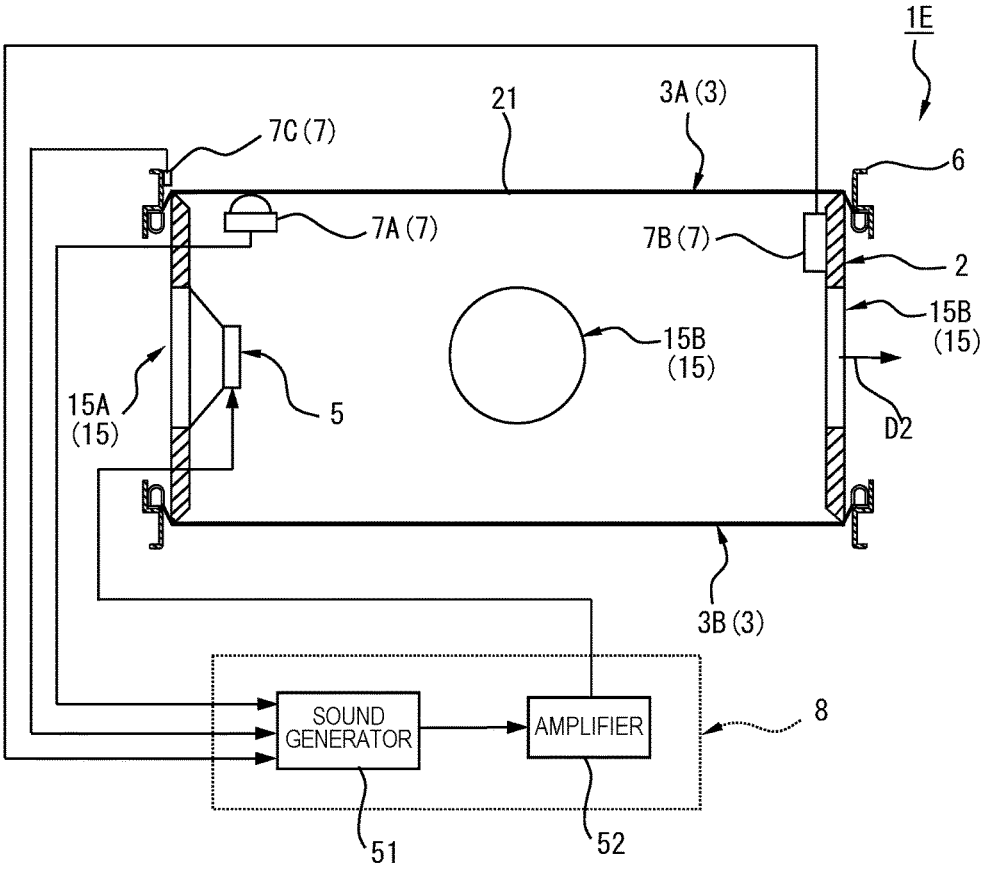
FIG. 4 is a simplified cross-sectional view of a percussion instrument according to a modified example of the third embodiment.

In this case, for example, the percussion instrument can comprise a plurality of sensors 7 (7A, 7B, 7C) as shown in FIG. 4, and the plurality of sensors 7 can be provided to mutually different portions of the percussion instrument. With such a configuration, the plurality of sensors 7 can detect sounds and vibrations of mutually different portions of the percussion instrument. In addition, the speaker driving unit 8 can drive the speaker 5 by outputting different input signals to the speaker 5, in accordance with detection signals that are output from, for example, one or a plurality of the plurality of sensors 7. Thus, it is possible to output different sounds from the speaker 5 in accordance with the portion of the percussion instrument that is struck.

In the percussion instrument illustrated in FIG. 4, the first sensor 7A is provided to the head 3 and mainly detects vibration and sound of the head 3. In addition, the second sensor 7B is provided to the shell 2 and mainly detects vibration and sound of the shell 2, Additionally, the third sensor 7C is provided to the hoop 6 and mainly detects vibration and sound of the hoop 6. With such a configuration, it is possible to make the sound that is output from the speaker 5 when the head 3 is struck, the sound that is output from the speaker 5 when the shell 2 is struck, and the sound that is output from the speaker 5 when the hoop 6 is struck to be different from one another.

In addition, for example, the plurality of sensors 7 can be provided to mutually different portions of the same head 3. In this case, it is possible to output different sounds from the speaker 5 in accordance with the region of the head 3 that is struck. In the same manner, the plurality of sensors 7 can be provided, for example, to mutually different portions of the shell 2, or can be provided, for example, to mutually different portions of the same hoop 6.

As described above, in the case that different sounds are output from the speaker 5 in accordance with the portion of the percussion instrument that is struck, it is possible to further diversify the sounds that are emitted from the percussion instrument and to improve the expressiveness and functionality of the percussion instrument.

The configuration of the third embodiment described above is not limited to being applied to the percussion instrument 1 of the first embodiment, and can also be applied to, for example, the percussion instrument 1C of the second embodiment.

Fourth Embodiment

Figure 5:
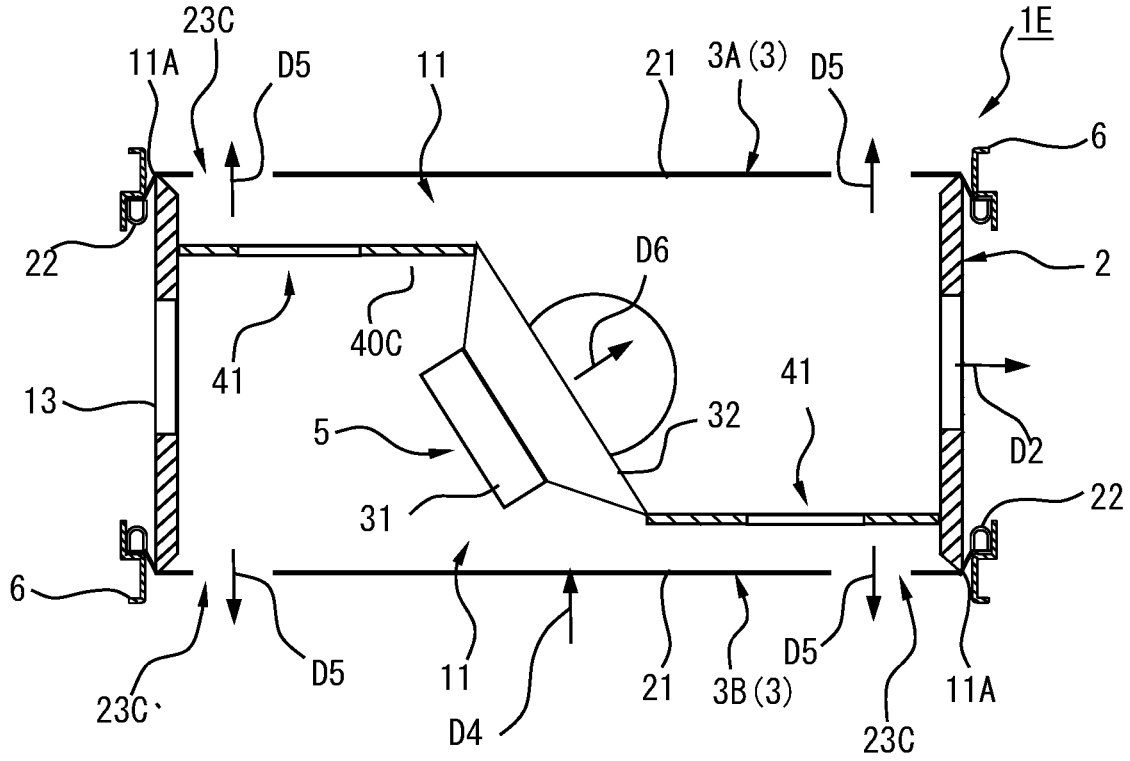
FIG. 5 is a simplified cross-sectional view of a percussion instrument according to a fourth embodiment

Next, the fourth embodiment of the present invention will be described with reference to FIG. 5. In the fourth embodiment, the same compositional elements as those in the first embodiment have been given the same reference symbols, and the descriptions thereof have been omitted.

As shown in FIG. 4, the percussion instrument 1E of the fourth embodiment comprises the same shell 2, the same head 3, and the same speaker 5 as in the first embodiment. Thus, the speaker 5 of the fourth embodiment can be connected the external device 34 by the wiring W similar to FIG. 1, and/or can be provided with provided with the wireless receiver 36 wirelessly communication with the external device 34.

In the percussion instrument 1E of the fourth embodiment, the speaker 5 can be disposed, for example, so as to output sound toward both the opening 11 of the shell 2 and the wall portion 13 of the shell 2. That is, the main sound that is output from the speaker 5 can be propagated in both the axial direction and the radial direction of the shell 2, so as to directly reach both the opening 11 of the shell 2 and the wall portion 13 of the shell 2.

More specifically, in the speaker 5 of the fourth embodiment, the diaphragm 32 is formed into a truncated cone shape having a center axis that the whole cone has a circular symmetry. Accordingly, the main sound that emanates from the speaker 5 is output from the inner surface of the conical diaphragm 32 as a spherical wave propagating in a D6 direction (the main direction of propagation). In the case of a speaker having cone shaped diaphragm, the main direction of propagation of the sound as used herein corresponds to the cylinder having a diameter that is equal to a diameter of a base of the cone shaped diaphragm and a center coincident to a center of the base of the cone shaped diaphragm. In addition, in the speaker 5 of the fourth embodiment, other sound is also transmitted from the outer surface of the conical diaphragm 32 in the direction opposite to the D6 direction as well as in the direction orthogonal to the D6 direction.

In this case, the percussion instrument 1E can comprise, for example, the speaker that outputs sound toward both the opening 11 of the shell 2 and the wall portion 13 of the shell 2. Specifically, the speaker 5 similar to that of the first and second embodiments (the speaker 5 having the conical diaphragm 32) can be disposed such that the arrangement direction of the vibrator 31 and the diaphragm 32 is inclined with respect to both the radial direction and the axial direction of the shell. In addition, the speaker 5 of the percussion instrument 1E can be configured to radiate sound in all directions.

The present invention was described in detail above, but the present invention is not limited to the above-described embodiments, and various modifications can be made without departing from the scope of the invention.

Additionally, the percussion instrument can comprise both a first, speaker that is similar to the first embodiment, which is disposed so as to output sound toward the wall portion of the shell, and a second speaker that is similar to that of the second embodiment, which is disposed so as to output sound toward the opening of the shell.

Such a percussion instrument provides the same effects as those of both the first and second embodiments.

What is clamed is:

1. A percussion instrument comprising:

a shell having a wall portion and at least one opening;

a head attached to the shell and overlying the at least one opening of the shell; and a speaker provided inside of the shell and oriented to output sound having a main direction of propagation towards the wall portion of the shell according to an input signal.

2. The percussion instrument as recited in claim 1, wherein the speaker is further oriented to output the sound such that the main direction of propagation of the sound is directed towards both the wall portion of the shell and the opening of the shell.

3. The percussion instrument as recited in claim 1, further comprising at least one sensor provided to detect at least one of vibration and sound of a predetermined portion of the percussion instrument, and the speaker is configured to output the sound in response to a detection signal of the at least one sensor when the predetermined portion of the percussion instrument is struck.

4. The percussion instrument as recited in claim 3, further comprising a sound generator operatively connected to the speaker to output the input signal to the speaker, and operatively connected to the sensor to receive the detection signal of the sensor.

5. The percussion instrument as recited in claim 4, further comprising an amplifier operatively connected to the sound generator and the speaker.

6. The percussion instrument as recited in claim 3, wherein the at least one sensor includes a sensor provided to the head to detect at least one of vibration and sound generated from the head being struck.

7. The percussion instrument as recited in claim 3, wherein the at least one sensor includes a sensor provided to the shell to detect at least one of vibration and sound generated from the shell being struck.

8. The percussion instrument as recited in claim 3, wherein the head is attached to the shell, by a hoop, and the at least one sensor includes a sensor provided to the hoop to detect at least one of vibration and sound generated from the hoop being struck.

9. The percussion instrument as recited in claim 1, wherein the wall portion includes a plurality through-holes.

10. The percussion instrument as recited in claim 9, wherein the speaker is attached to the wall portion such that a primary axis of the main direction of propagation of the sound passes through one of the through-holes.

11. The percussion instrument as recited in claim 10, wherein another one of the through-holes in the wall portion is located directly opposite the main direction of propagation of the sound passes through the one of the through-holes.

12. The percussion instrument as recited in claim 2, wherein the head includes an inner membrane portion overlying the at least one opening of the shell, and the inner membrane portion includes at least one hole spaced inwardly from the wall portion of the shell towards a middle of die at least one opening.

13. A percussion instrument comprising:

a shell having a wall portion and at least one opening;

a head attached to the shell and overlying the at least one opening of the shell;

a speaker provided inside of the shell and oriented to output sound having a main direction of propagation towards the at least one opening of the shell having the head according to an input signal; and a support member supporting the speaker to the shell and dividing an interior of the shell into a first space and a second space, the support member including at least one through-hole communicating the first space to the second space, the first space being located between the head and a closest point of the speaker to the head.

14. The percussion instrument as recited in claim 13, wherein the head includes an inner membrane portion overlying the at least one opening of the shell, and the inner membrane portion includes at least one hole spaced inwardly from the wall portion of the shell towards a middle of the at least one opening.

15. The percussion instrument as recited in claim 14, wherein the at least one hole includes a plurality of the holes spaced inwardly from the wall portion of the shell towards the middle of the at least one opening.

16. The percussion instrument as recited in claim 14, wherein the at least one opening includes a first opening having the head with the inner membrane portion, and a second opening disposed on an opposite side of the wall portion, of the shell from the first opening.

17. The percussion on instrument as recited in claim 16, further comprising an additional head attached to the shell and overlying the second opening, the additional head includes an additional inner membrane portion overlying the second opening of the shell, the additional inner membrane portion includes at least one hole spaced inwardly from the wall portion of the shell towards a middle of the second opening.

18. The percussion instrument as recited in claim 13, wherein the at least one through-hole includes two through-holes that are symmetrically arranged with respect to a center of the speaker.

19. The percussion instrument as recited in claim 13, further comprising at least one sensor provided to detect at least one of vibration and sound of a predetermined portion of the percussion instrument, and, the speaker is configured to output the sound in response to a detection signal of the at least one sensor when the predetermined portion of the percussion instrument is struck.

20. The percussion instrument as recited in claim 13, further comprising a sound generator operatively connected to the speaker to output the input signal to the speaker, and operatively connected to the sensor to receive the detection signal of the sensor.

* * * * *